US005642665A

United States Patent [19]

Horie

[11] Patent Number: 5,642,665

[45] Date of Patent: Jul. 1, 1997

[54] STENCIL STAMP ASSEMBLY AND METHOD FOR PREPARATION THEREOF

[75] Inventor: Mariko Horie, Ibaraki-ken, Japan

[73] Assignee: Riso Kagaku Corporation, Tokyo, Japan

[21] Appl. No.: 642,639

[22] Filed: May 3, 1996

[30] Foreign Application Priority Data

May 8, 1995 [JP] Japan ..... 7-109667

[51] Int. Cl.[6] ..... B41L 13/02

[52] U.S. Cl. ..... 101/125; 101/112; D18/15

[58] Field of Search ..... D18/14, 15; 101/112, 101/125

[56] References Cited

U.S. PATENT DOCUMENTS

| | | | |
|---|---|---|---|
| 2,034,191 | 3/1936 | Innes | 101/125 |
| 3,298,304 | 1/1967 | Carlsen | D18/15 |
| 4,128,057 | 12/1978 | Hayama et al. | 101/128.21 |
| 4,395,948 | 8/1983 | Monich | D18/15 |
| 5,463,947 | 11/1995 | Taira | 101/125 |

FOREIGN PATENT DOCUMENTS

| | | | |
|---|---|---|---|
| 250081 | 5/1948 | Switzerland | 101/125 |

*Primary Examiner*—Edgar S. Burr
*Assistant Examiner*—Daniel J. Colilla
*Attorney, Agent, or Firm*—Kanesaka & Takeuchi

[57] ABSTRACT

A stencil stamp assembly is formed of: a stencil sheet having a perforation area having an image perforated therein, at least two plate members having lower end portions secured to the stencil sheet at at least two positions with the perforation area sandwiched therebetween and upper end portions connected with each other, the plate members serving as operating portions during printing, an ink holding portion for holding ink on the upper surface of the perforation area of said stencil sheet, and a center member having a plurality of surfaces in contact with at least a part of the inner surface of the plate members and the upper surface of said ink holding portion. The center member is provided in a space between the inner surface of the plate members and the upper surface of the ink holding portion.

9 Claims, 5 Drawing Sheets

STENCIL STAMP ASSEMBLY AND METHOD FOR PREPARATION THEREOF

BACKGROUND OF THE INVENTION

The present invention relates to a printing stamp using a perforated stencil sheet and a method for preparation thereof.

In the past, in a hand printer using a stencil sheet, an original to be printed is used and a stencil sheet is heat sensitively perforated, and after perforation, a print body can be printed using ink.

This hand printer has the size suitable for printing a card, such as a postcard. Various parts are formed adjusting to the aforesaid size.

Accordingly, printing using the above-described hand printer is not suitable for printing those other than the postcard size.

That is, in printing after perforation, a stencil sheet is set to the hand printer and printing is performed while operating the hand printer. Therefore, there has been encountered cumbersome in that even if a sheet having a smaller size than a postcard is printed, a relatively large hand printer has to be operated.

As means for simply performing printing of those smaller in size than a postcard, a small rubber stamp called a fancy stamp is commercially available. However, it has been difficult for an individual to simply prepare a stamp in which a print surface is prepared in advance and an original such as a picture or name written by himself (or herself) can be printed.

SUMMARY OF THE INVENTION

The present invention has been accomplished in order to solve the above-described problem. It is an object of the present invention to provide a stencil stamp assembly which can easily print a suitable image of a smaller size than a postcard using a stencil sheet and can be simply prepared and a method for preparation thereof.

A stencil stamp assembly according to a first aspect comprises a stencil sheet having a perforation area having an image perforated therein, at least two plate members having lower end portions secured to the stencil sheet at at least two positions with the perforation area sandwiched therebetween and upper end portions connected with each other, the plate members serving as operating places during printing, an ink holding portion for holding ink on the upper surface of the perforation area of the stencil sheet, and a center member having a plurality of surfaces in contact with at least a part of the inner surface of the plate members and the upper surface of the ink holding portion, the center member being provided in a space between the inner surface of the plate members and the upper surface of the ink holding portion.

In the stencil stamp assembly of a second aspect, according to the first aspect, the plate members comprise two rectangular plate members secured to the stencil sheet at at least two places having the perforation area sandwiched therebetween so that lower sides as lower end portions are parallel with each other and so that upper sides as upper end portions which are sides opposed to the lower sides are parallel with each other, and the center member is a generally triangular column shape provided vertically movably within a generally triangular space constituted by the two plate members and the perforation area of the stencil sheet.

In the stencil stamp assembly of a third aspect, according to the second aspect, each of the upper sides of the plate members is provided with stops which stop each other.

In the stencil stamp assembly of a fourth aspect according to the first aspect, the ink holding portion has ink arranged on the perforation area of the stencil sheet and a portion other than the perforation area of the stencil sheet folded on the upper surface side of the stencil sheet to embrace the ink.

In the stencil stamp assembly of a fifth aspect, according to the first aspect, the ink holding portion has ink arranged on the perforation area of the stencil sheet and a film placed upon the upper surface of the stencil sheet to embrace and hold the ink.

In the stencil stamp assembly of a sixth aspect, according to the first aspect, the assembly further comprises an elastic member of a predetermined thickness provided between the ink holding portion and the center member.

A method for preparing a stencil stamp assembly according to a seventh aspect comprises the steps of: a first step of perforating an image corresponding to an original in a perforation area of a stencil sheet; a second step of securing ends of at least two plate members to the stencil sheet at at least two positions having the perforation area sandwiched therebetween; a third step of putting ink on the perforation area of the stencil sheet; a fourth step of sealing the ink on the perforation area of the stencil sheet; a fifth step of providing a generally triangular column shape center member on said sealed ink, said triangular column shape center member having a lower end in contact with the sealed ink and two continuous inclined surfaces at a predetermined inclination angle from the lower surface; and a sixth step of raising the other ends of the plate members on the side of the center member to join them each other and assembling the plate members into a generally triangle shape surrounding the center member.

In the method for preparing a stencil stamp assembly of an eighth aspect, according to the seventh aspect, in the first step, a perforation board is used, said perforation board having an original frame defined in advance showing the size of an original corresponding to the perforation area and an outer frame defined in advance showing the size of a larger stencil sheet than the perforation area; the original is located within the original frame of the perforation board and the stencil sheet is heat sensitively perforated, and the stencil sheet is cut along the perforated outer frame to thereby obtain the stencil sheet in which an image corresponding to the image of the original is perforated on the perforation area.

In the method for preparing a stencil stamp assembly of a ninth aspect, according to the seventh aspect, in the second step, a locating sheet is used, said locating sheet having a locating frame defined in advance for locating the stencil sheet and an adhesive position frame defined in advance showing adhesive positions of the plate members with respect to the stencil sheet: the stencil sheet is located by the locating frame of said locating sheet; and the plate members are located with respect to the stencil sheet by the adhesive position frame of the locating sheet.

According to the above-described construction, at least the following functions are obtained.

At least two plate members are adhered to both sides of a stencil sheet having a perforation area such as an image. The plate members are raised from both sides of the perforation area and joined on the side of the other ends so as to serve as the operating or holding portion during printing. The plate members are rectangular plates in which the other ends are stopped each other by stops. A triangular column shape center member is provide in a space of the plate members assembled into a triangular shape. The lower surface of the center member is in contact with the ink holding portion on the stencil sheet. In the ink holding portion, the stencil sheet other than the perforation area is folded to embrace the ink arranged on the perforation area of the stencil sheet, or the ink arranged on the stencil sheet is held by placing films one upon another. When the plate members are gripped and the pressing force is applied from the top, the internal center member is moved downward to push the ink holding portion. The ink held within the ink holding portion passes through the perforation portion of the stencil sheet and moves onto a sheet to be printed in the shape corresponding to the perforation image whereby the image is stamp-printed.

DETAILED DESCRIPTION OF THE PREFERRED EMBODIMENTS

The embodiments of a stencil stamp assembly according to a stencil sheet of the present invention is explained.

Figure 1:
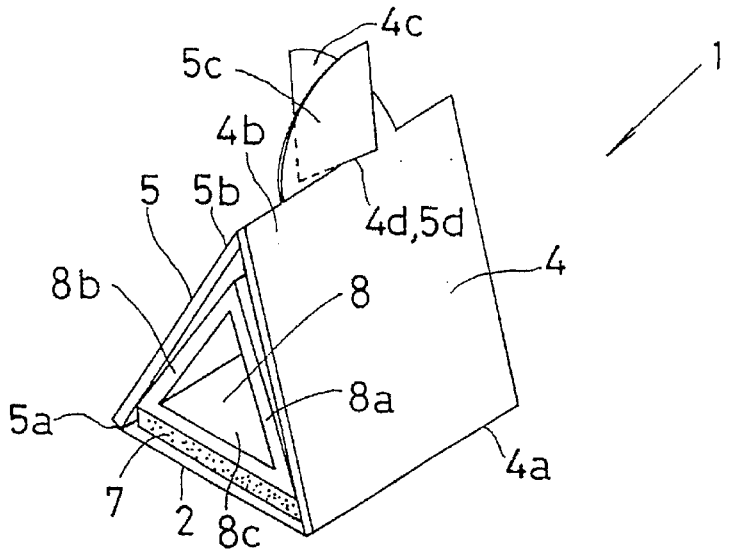
FIG. 1 is a perspective view showing a first embodiment of a stencil stamp assembly.

FIG. 1 is a perspective view showing a stencil stamp assembly 1 according to a first embodiment. The stencil stamp assembly 1 will be roughly explained with reference to FIG. 1. This stencil stamp assembly 1 is formed into a generally triangle shape as viewed from the side.

A perforated stencil sheet 2 having a perforation area of an image or the like is provided on the lower surface portion, and both ends of the stencil sheet 2 are joined to ends 4*a*, 5*a* of plate members 4, 5, respectively.

The plate members 4, 5 can be formed of cardboard, plastic, etc.

The plate members 4, 5 has the other ends 4*b*, 5*b* joined to each other, and the sides thereof are formed into a generally triangle shape by the stencil sheet 2 and the plate members 4, 5.

Engaging pieces 4*c*, 5*c* are projected from the other ends 4*b*, 5*b* of the plate members 4, 5, and cuts 4*d*, 5*d* of the engaging pieces 4*c*, 5*c* are engaged with each other to thereby hold the other ends 4*b*, 5*b* of the plate members 4, 5 in the joined state.

Ink of predetermined color is placed on the stencil sheet 2, and the stencil sheet 2 is folded to thereby prevent the ink from leaking out of the side.

An elastic body 7 such as a sponge having a predetermined thickness, corresponding to the size of the stencil sheet 2, is provided on the stencil sheet 2.

A center member 8 is provided in a triangular central opening formed by the plate members 4, 5 and the stencil sheet 2.

The center member 8 is a generally triangular plate member, in which inclined surfaces 8*a*, 8*b* are positioned internally of the plate members 4, 5, and a lower surface 8*c* is positioned on the elastic body 7. Accordingly, the center member 8 is constituted by folding a material wherein the length of the inclined surfaces 8*a*, 8*b* is small at least by the length corresponding to the thickness of the plate members 4, 5.

It is to be noted that plastic formed into a triangle shape in advance can be used for the center member 8.

Next, the operation for assembling the aforementioned stamp will be described.

Figure 2:
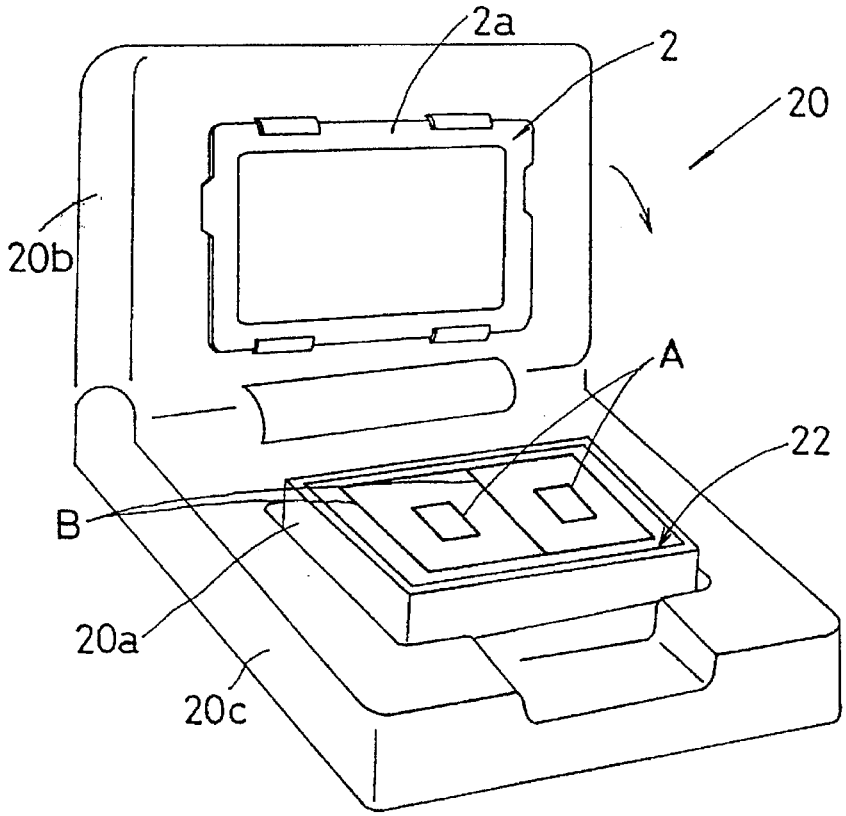
FIG. 2 is a view showing a hand printer for perforating an original image on a stencil sheet.

First, perforation is formed in a stencil sheet. In the case where an original image is perforated in the stencil sheet by a hand printer 20 with a general-use perforation function as shown in FIG. 2, the stencil sheet 2 having the size adapted for the hand printer 20 is to be used.

In this case, if a board 22 for perforation is used as shown, a plurality of images can be perforated at the same time, which is positioned within a single stencil sheet 2. These images can be used for a variety of stamps.

In the board for perforation 22, an original frame A having the same size as the image is formed, and an outer frame B having the size necessary for preparing a stamp is provided outside the original frame A. This board for perforation 22 is placed on a pedestal 20*a* of the hand printer 20.

Next, an original 23 formed with letters, images or the like as desired along a frame line is placed on the original frame A of the board for perforation 22.

Thereafter, when a pressing plate 20*b* of the handy printer 20 is closed on the side of a base 20*c* to operate a light irradiation device (not shown), perforation corresponding to the original 23 is provided on the stencil sheet 2. Thereafter, the original 23 is adhered to the stencil sheet 2. This adhered state remains immediately before printing starts which will be described below.

The stencil sheet 2 is constituted such that the whole periphery of the edge thereof is supported by a frame 2*a* formed of a cardboard and a transparent film is placed on the deep side in the figure.

However, in the stamp according to the present invention, these frame 2*a* and the transparent film are not necessary and can be removed by cutting them off or the like.

Next, since the outer frame B is also linearly perforated on the stencil sheet 2, they are cut off along the outer frame B. Thereby, the images used for the plurality of stamps are separated, and the size necessary for each of the stamps can be easily obtained.

Figure 3:
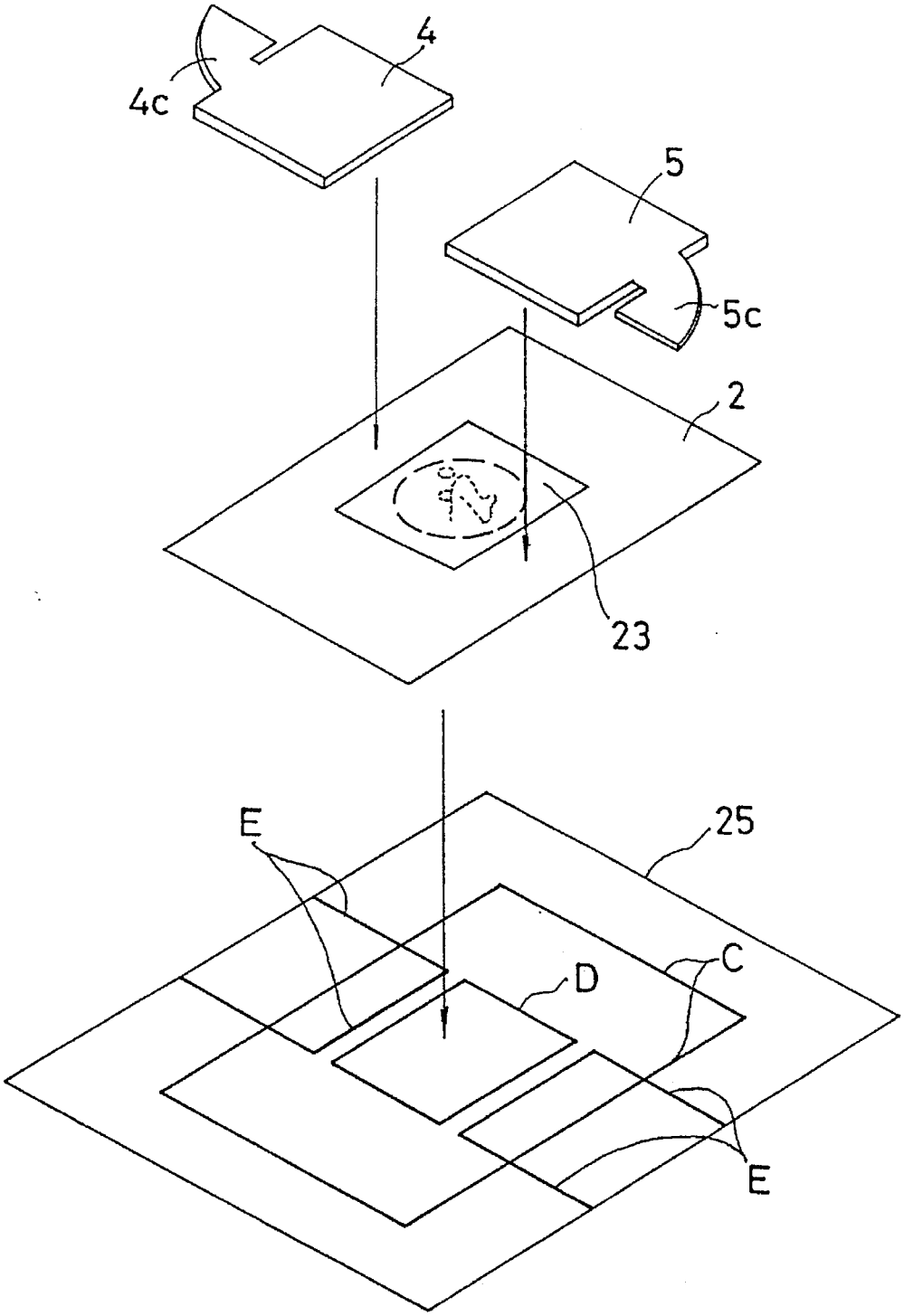
FIG. 3 is a view showing an assembled state of the stamp.

Next, as shown in FIG. 3 showing the assembly state, the stencil sheet 2 is set so that the surface to which the original 23 is adhered appears upward, and the plate members 4, 5 are adhered to the sides of the original 23. In adhesion, the engaging pieces 4*c*, 5*c* are positioned outwardly of the stencil sheet 2. This adhesion can be easier by using an adhesive tape on the back of the plate members 4, 5 in advance.

Further, the aforementioned adhesion can be facilitated by using a locating sheet 25 shown below in the figure.

The locating sheet 25 is provided with a locating frame C adjacent to the outer diameter (edge) of the stencil sheet 2, and an image frame D of the original 23 and an adhesion position frame E showing a adhesion position of the plate members 4, 5 are provided.

Accordingly, in the state where the stencil sheet 2 is positioned at the locating frame C of the locating sheet 25 and the image of the original 23 is positioned at the image frame D, the adhesion position frame E can be seen through the stencil sheet 2, and therefore, if the plate members 4, 5 are adhered therealong, they can be easily adhered to accurate positions.

Figure 4:
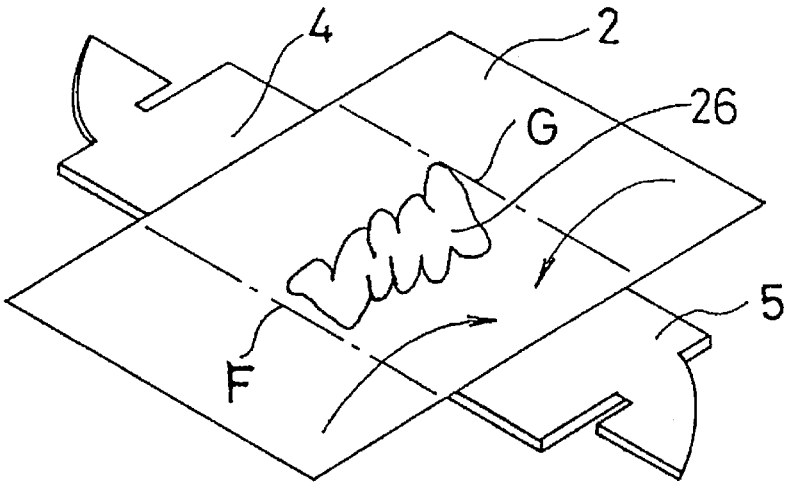
FIG. 4 is a view showing an assembled state of the stamp in the subsequent step.

Next, as shown in FIG. 4, after the stencil sheet 2 having the plate members 4, 5 adhered thereto has been inverted, a predetermined amount of printing ink 26 is placed on the image plane in the central portion.

Thereafter, both ends of the stencil sheet 2 is folded in the central direction so as to embrace the ink 26 to form an ink holding portion. At this time, the stencil sheet 2 is folded at the fold line F, G along both the ends of the plate members 4, 5. With this, the ink 26 is sealed within the stencil sheet 2 whereby the airtightness inside said ink holding portion is kept, to enable the passage of the ink 26 through only the stencil image portion.

Figure 5:
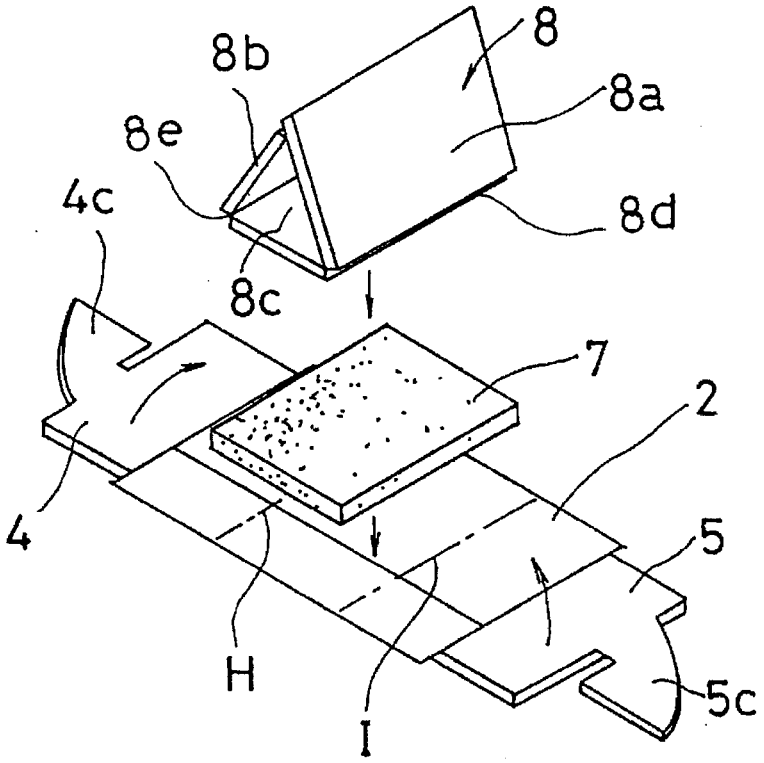
FIG. 5 is a view showing an assembled state of the stamp in the further subsequent step.

Thereafter, the elastic body 7 and the center member 8 are placed on the central portion, as shown in FIG. 5. The center member 8 is preformed with cuts 8*d*, 8*e* at two places of the cardboard, and can be formed by being folded into a generally triangle shape along the cuts 8*d*, 8*e*.

It is to be noted that the elastic body 7 may be provided in advance on the lower surface 8*c* of the center member 8.

Then, after the plate members 4, 5 have been folded along fold lines H, I, in a direction close to each other the cuts 4*d*, 5*d* of the engaging pieces 4*c*, 5*c* are fixed each other whereby the stamp 1 shown in FIG. 1 can be assembled. The fold lines H, I are folded along the ends of the plate members 4, 5 adhered to the stencil sheet 2.

Thereafter, the original 23 affixed to the lower surface of the stencil sheet 2 is peeled off, and after test printing, stamp printing can be performed continuously.

According to the stamp 1 constructed as described above, the perforation surface of the stencil sheet 2 is positioned on the lower surface, and the plate members 4, 5 are held and pressed from the top whereby the ink held inside can transmit to apply printing corresponding to the image.

Since at least two sides of the plate members 4, 5 are inclined and the center member 8 of the triangle shape which is separated from the plate members 4, 5 is provided internally thereof, when the plate member 4, 5 are pressed from the top, its pressing force is transmitted to the lower surface 8*c* through the inclined surfaces 8*a*, 8*b* of the center member 8 and the whole surface of the lower surface 8*c* presses the stencil sheet 2 toward the printing body.

Thereby, a printed image of good quality can be formed.

By the construction in which the outer plate members 4, 5 are separated from the center member and when pressed, they come in contact, even if the ink is used up, the plate members 4, 5 are pressed from the top whereby the center member 8 moves downward to feed the ink 26. Therefore, an image in a constant amount of ink can be printed irrespective of the amount of ink.

Further, the assembled state can be maintained merely by fixing the engaging pieces 4*c*, 5*c* provided on the plate members 4, 5, and after assembly, the engaging pieces 4*c*, 5*c* do hardly slip when held by hands. Further, disassembly can be easily done merely releasing the fixed state of the engaging pieces 4*c*, 5*c*, and the ink can be replenished.

Furthermore, the ink 26 is embraced and sealed by the stencil sheet 2 to thereby prevent the ink 26 from being dried. In order that the ink 26 is prevented from being dried in the case where the stamp 1 is not used for a certain period of time, it is necessary to embrace the lower surface portion (a stencil image forming place) where the stencil sheet 2 of the stamp 1 is exposed so that the aforesaid lower surface portion is not left in the open air.

Further, the ink 26 is embraced by the stencil sheet 2, whereby even if plural colors of the ink 26 are used, these ink 26 are not spread to lessen the occurrence of mixed color.

Further, the elastic body 7 is provided between the center member 8 and the stencil sheet 2 whereby the force for pressing the stencil sheet 2 toward the printing body can be made constant irrespective of the pressing force from the top during operation to prevent the ink 26 from being excessively fed. Even if the ink 26 is reduced, the amount of feeding the ink can be made even by the elastic force of the elastic body 7.

Incidentally, as shown in FIG. 1, the stencil sheet 2 formed with an image of print has both ends adhered to the one ends 4*a*, 5*a* of the plate members 4, 5 and the pressing force applied from the top during printing is received by the ends 4*a*, 5*a*. Therefore, the force more than a predetermined pressing force is not applied to the stencil sheet 2 to prevent the ink 26 from being excessively fed, thus making print quality even.

Figure 6:
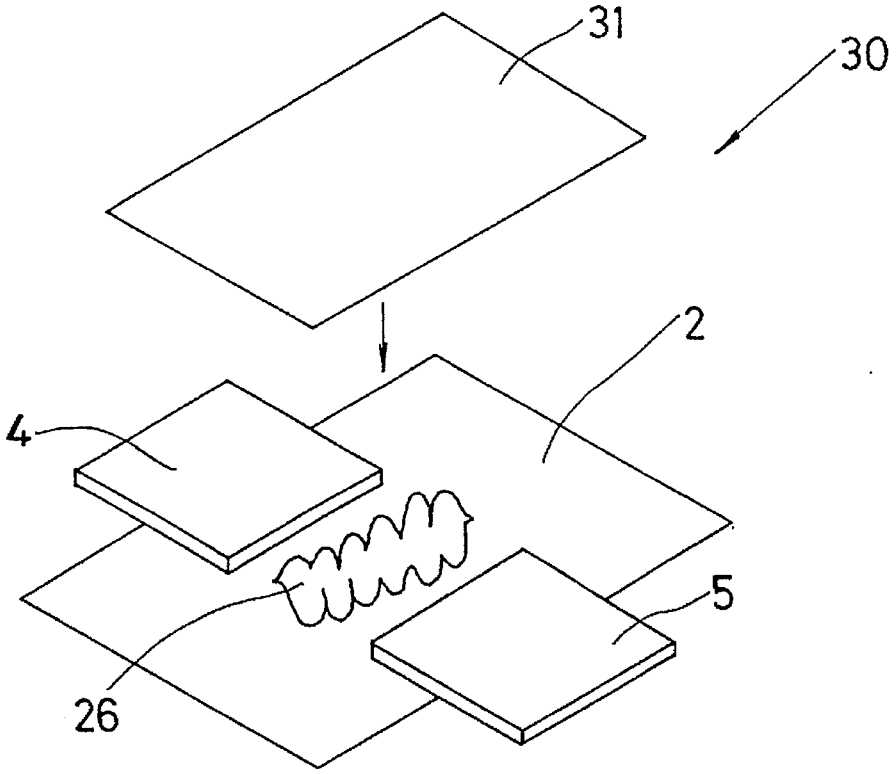
FIG. 6 is an assembly view showing a second embodiment.

Next, FIG. 6 is a view showing an assembly stencil stamp assembly 30 according to a second embodiment of the present invention. The fundamental construction is similar to that of the first embodiment. The same parts are indicated by the same reference numerals, and description thereof is omitted.

In this embodiment, the plate members 4, 5 are adhered to the surface side in the state where the original 23 is affixed to the back side of the stencil sheet 2 shown in FIG. 6, and after the ink 26 has been placed between the plate members 4, 5, a film 31 for preventing a leakage of ink is placed thereon to form an ink holding portion to seal the ink.

Figure 7:
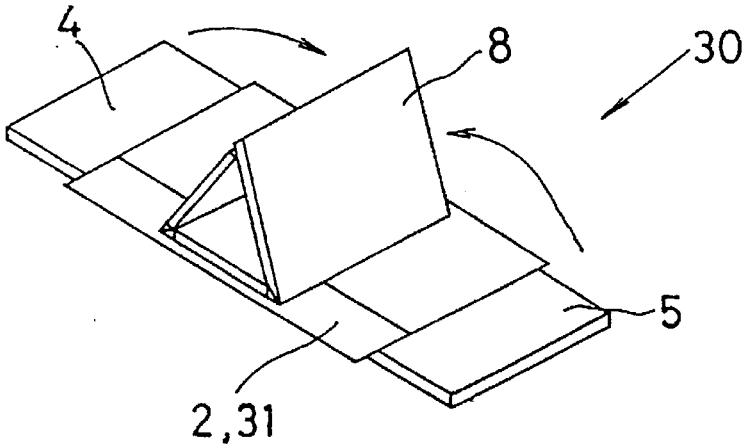
FIG. 7 is a view showing an assembled state of the stamp in the subsequent step.

Next, after the ink is embraced by the film 31, the stencil sheet 2 is placed on the center member 8, and the plate members 4, 5 are folded to prepare a stamp 30, as shown in FIG. 7.

In this embodiment, although the plate members 4, 5 are not provided with the engaging pieces 4*c*, 5*c*, the top portions where the plate members 4, 5 are in contact with each other may be adhered to each other by an adhesive tape.

Further, in the case where the elastic body 7 is not provided as shown, if the pressing force applied from the top during the printing operation is adjusted, in place of the function of the elastic body 7, the amount of feeding the ink 26 can be adjusted, making the print quality even.

Figure 8:
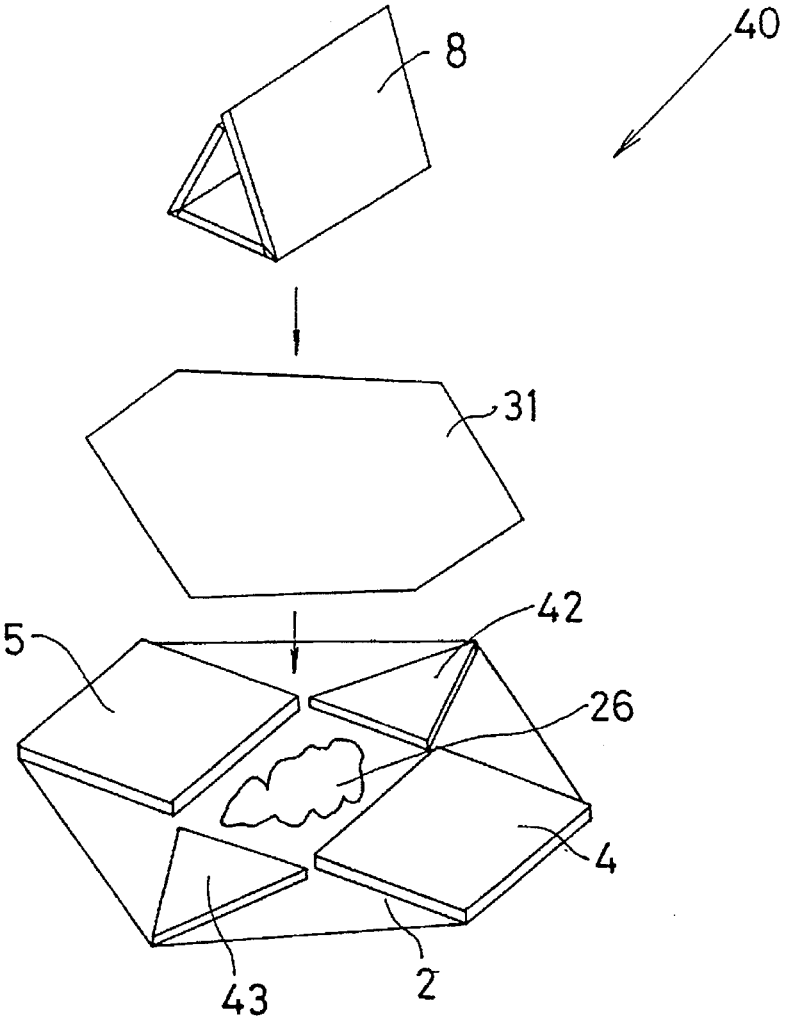
FIG. 8 is an assembly view showing a third embodiment.

Next, FIG. 8 is a view showing an assembly stencil stamp assembly 40 according to a third embodiment of the present invention. The fundamental construction is similar to that of the first embodiment. The same parts are indicated by the same reference numerals, and description thereof is omitted.

In this embodiment, a pair of plate members 4, 5 and triangular side plate members 42, 43 are adhered to the surface side in the periphery of the image plane in the state where the original 23 is affixed to the back side of the stencil sheet 2 shown in FIG. 8.

At this time, the stencil sheet 2 is cut off into a generally hexagonal shape along the line which passes the outermost side of the plate members 4, 5 and the triangular side plate members 42, 43.

Thereafter, after the ink 26 has been placed on the image plane, a hexagonal film 31 for preventing a leakage of ink, which has a size smaller than that of the stencil sheet 2, is placed thereon to form an ink holding portion to seal the ink.

Figure 9:
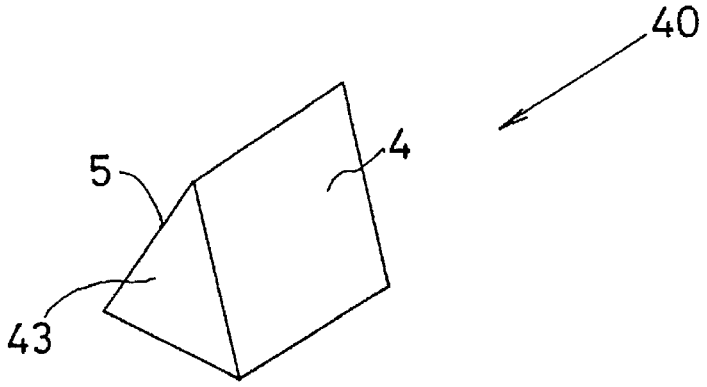
FIG. 9 is a view showing an assembled state of the stamp in the subsequent step.

Then, the central member 8 is placed on the film 31, and the plate members 4, 5 and the side plate members 42, 43 are folded to prepare a stamp 40, as shown in FIG. 9.

Also in this embodiment, the edge portions with which the plate members 4, 5 and the side plate members 42, 43 contact are adhered to each other by an adhesive tape.

Any of the aforementioned embodiments has the construction which has a generally triangle shape in which the stencil sheet 2 is affixed between ends 4*a*, 5*a* of the plate members 4, 5 and the triangular center member 8 is provided therein. Therefore, the pressing force applied from the top during printing comprises the force by which the center member 8 presses the lower surface 8*c* in the direction directly below and evenly pressing the whole image plane of the stencil sheet 2 in the direction of the printing body. In these embodiments, both the plate members 4, 5 and the center member 8 have the inclined two sides, thus requiring the minimum number of members for construction.

If a design is made so that the pressing force from the top causes the whole image surface of the stencil sheet 2 to be pressed against the printing body evenly, the whole shape is not limited to a triangle shape but other shapes can be employed.

As concrete modifications, the side sections of the center member 8 provided within the plate members 4, 5 may have a form of a semicircle, a pentagonal in general and the like.

Since the present invention provides a stamp using a stencil sheet, printing with the color can be made only by providing ink of suitable color on the surface opposite to the print surface. In addition, in the case that a plurality of colors is prepared in advance, printing with these colors can be made. That is, in the conventional stamp using a stamp bed, it is necessary to prepare the stamp beds in the number corresponding to a plurality colors. However, in the present invention, plural colors of ink may be merely prepared and contained in the stamp, and a multi-color stamp can be easily obtained by the simple construction.

According to the stencil stamp assembly by a stencil sheet of the present invention, the plate members are provided on the side of the perforation area of the stencil sheet on which an image is perforated, and the internal center member presses the ink holding portion through the plate members by the printing operation to effect the stamp printing. The stamp printing can be made easily by using the stencil sheet having a desired image perforated.

According to the construction of the invention wherein the plate members are inclined from the stencil sheet into a generally triangle shape and the triangular center member is provided therein. Thus, when the plate members are pressed from the top during printing, the lower surface is moved downward through the inclined surface of the internal center member so that the ink holding portion is pressed by the whole surface, thus improving print quality.

As described in the invention, if the engaging pieces are provided on the joining portions of the plate members, these stops can be merely fixed to each other to maintain the assembly state of the stamp. The preparation thereof can be facilitated, and the disassembling when the ink is replenished or the like becomes easy.

According to the construction of the invention wherein the ink holding portion embraces ink by folding the stencil sheet or according to the construction of the invention wherein the films are placed one upon another on the stencil sheet, the ink is prevented from being dried and leaked, rendering use for a long period of time possible.

According to the construction of the invention wherein the elastic body is provided between the stencil sheet and the center member, the elastic body presses the ink holding portion by the elastic force of even surface to apply printing with an even concentration.

The preparation method of the invention provides simple steps of merely directly adhering the plate members to the stencil sheet after perforation to seal ink, and providing the center member inside and folding the plate members each other. Therefore, the stamp can be easily prepared, the number of necessary parts is minimum.

When the board for perforation is used during perforation, an original position on the stencil sheet can be easily located. Since the outer frame of the stencil sheet can be known simply after perforation, the size of necessary stencil sheet can be preset according to the size of image to facilitate the preparation of stamp. Further, a plurality of originals can be simultaneously perforated on a single stencil sheet in advance, and the perforation operation can be facilitated and resources such as a lamp light source of a light irradiation device necessary for the perforation operation can be efficiently used.

In case the locating sheet is used when the plate members are adhered to the stencil sheet, the adhesive position of the plate members with respect to the stencil sheet can be easily located to facilitate the preparation of stamp.

What is claimed is:

1. A stencil stamp assembly comprising:

a stencil sheet having a perforation area with an image perforated therein;

at least two plate members having lower end portions permanently fixed to said stencil sheet at at least two positions with said perforation area sandwiched therebetween and upper end portions connected with each other, said plate members serving as operating portions for printing;

an ink holding portion for holding ink located on an upper surface of the perforation area of said stencil sheet;

a space surrounded by an upper surface of the ink holding portion and inner surfaces of the plate members; and a center member freely movably situated in the space and having at least three flat surfaces contacting the inner surfaces of said plate members and the upper surface of said ink holding portion so that when the plate members are pushed for printing, the center member situated in the space pushes the ink holding portion to allow the ink to pass through the perforation area to thereby perform printing.

2. The stencil stamp assembly according to claim 1, wherein said plate members comprise two rectangular plate members having lower sides parallel with each other and upper sides opposed to said lower sides which are parallel with each other; and said center member and said space are generally triangular column shapes so that the center member is provided vertically movably within the space.

3. The stencil stamp assembly according to claim 2, wherein said upper sides of each of said plate members is provided with a fixer for connecting with each other.

4. The stencil stamp assembly according to claim 1, wherein said stencil sheet has a portion not including said perforation area folded on an upper surface side of said stencil sheet to embrace said ink.

5. The stencil stamp assembly according to claim 1, wherein said ink holding portion arranged on said perforation area of said stencil sheet has a film placed upon an upper surface of said stencil sheet to embrace and hold said ink.

6. The stencil stamp assembly according to claim 1, further comprising an elastic member having a predetermined thickness and being provided between said ink holding portion and said center member.

7. A method for preparing a stencil stamp assembly comprising the steps of:

a first step of perforating an image corresponding to an original in a perforation area of a stencil sheet;

a second step of securing respective ends of at least two plate members to said stencil sheet at at least two positions having said perforation area sandwiched therebetween;

a third step of putting ink on the perforation area of said stencil sheet;

a fourth step of sealing said ink on the perforation area of said stencil sheet;

a fifth step of providing a generally triangular column shape center member on said sealed ink, said triangular column shape center member having a lower surface in contact with said sealed ink and two continuous inclined surfaces inclined at a predetermined inclination angle relative to said lower surface; and a sixth step of joining other ends of said plate members upon said center member to assemble said plate members into a generally triangle shape surrounding said center member.

8. The method according to claim 7, wherein in the first step, a perforation board is used, said perforation board having an original frame defined in advance showing a size of an original corresponding to said perforation area and an outer frame defined in advance showing a size of a stencil sheet which is larger than said perforation area;

the original is located within the original frame of said perforation board and the stencil sheet is heat sensitively perforated; and said stencil sheet is cut along the perforated outer frame to thereby obtain the stencil sheet in which the image corresponding to the image of the original is perforated on the perforation area.

9. The method according to claim 7, wherein in the second step;

a locating sheet having a locating frame defined in advance for locating a stencil sheet and an adhesive position frame defined in advance showing an adhesive position of the plate members with respect to the stencil sheet;

the stencil sheet is located by the locating frame of said locating sheet; and the plate members are located with respect to said stencil sheet by the adhesive position frame of said locating sheet.

* * * * *